US006212706B1

(12) United States Patent
Rossman et al.

(10) Patent No.: US 6,212,706 B1
(45) Date of Patent: Apr. 10, 2001

(54) TUB-STOOL COMBINATION

(75) Inventors: Jon R. Rossman, Chelmsford; Bryan R. Hotaling, Arlington; John A. MacNeil, Melrose, all of MA (US)

(73) Assignee: First Years Inc., Lake Forest, CA (US)

( * ) Notice: Subject to any disclaimer, the term of this patent is extended or adjusted under 35 U.S.C. 154(b) by 0 days.

(21) Appl. No.: 09/359,476

(22) Filed: Jul. 22, 1999

(51) Int. Cl.[7] ..... A47K 3/024
(52) U.S. Cl. ..... 4/572.1; 4/571.1
(58) Field of Search ..... 4/571.1, 572.1, 4/659, 584, 589, 590, 578.1, 579, 585, 586, 587, 902; D23/278

(56) References Cited

U.S. PATENT DOCUMENTS 2,518,604 * 8/1950 Douglas .
3,086,222 * 4/1963 Hall et al. .
3,416,163 * 12/1968 Jordan .
3,995,331 * 12/1976 Fotre et al. ..... 4/572.1
5,425,149 * 6/1995 Crossley et al. ..... 4/572.1
5,518,405 * 5/1996 Aiello ..... 4/902
5,575,021 * 11/1996 Harris ..... 4/902
5,978,976 * 11/1999 Chai ..... 4/902
6,018,826 * 2/2000 Yang ..... 4/572.1

* cited by examiner

*Primary Examiner*—Steven O. Douglas
*Assistant Examiner*—Khoa Huynh
(74) *Attorney, Agent, or Firm*—Fish & Richardson, P.C.

(57) ABSTRACT

A device includes a base providing an upwardly-directed cavity having a mouth at an upper end thereof and configured to receive a portion of a child and to hold water. A lid is movably coupled to the base and movable into a tub position and a stool position, the lid extending angularly upward and away from the cavity to provide a back rest when in the tub position and the lid being disposed at least partially over the mouth and providing a substantially horizontal top surface when in the stool position. The base and lid provide a bathtub capable of holding a portion of a child therein and water for bathing the child when the lid is in the tub position and provide a step stool adapted to support the weight of a person standing on the substantially horizontal surface when in the stool position.

18 Claims, 7 Drawing Sheets

TUB-STOOL COMBINATION

BACKGROUND OF THE INVENTION

This invention relates to a bathtub and a step stool and in particular to a device having both a bathtub configuration and a step stool configuration.

Infant-sized bathtubs have become increasingly popular and useful items to have. Bathing infants presents special concerns. Often infants do not have the strength to support themselves in a seated position and thus placing them in an adult-sized bathtub presents a risk that the infant will topple over and possibly drown in the bath water. For this reason, infant-sized bathtubs are often used.

Another useful item to have around a dwelling is a step stool. These devices help provide additional "height" so that otherwise unreachable places, or at least safely unreachable places, can be accessed safely.

SUMMARY OF THE INVENTION

In general, in one aspect, the invention features a device including a base providing an upwardly-directed cavity having a mouth at an upper end thereof and configured to receive a portion of a child and to hold water. A lid is movably coupled to the base and movable into a tub position and a stool position, the lid extending angularly upward and away from the cavity to provide a back rest when in the tub position and the lid being disposed at least partially over the mouth and providing a substantially horizontal top surface when in the stool position. The base and lid provide a bathtub capable of holding a portion of a child therein and water for bathing the child when the lid is in the tub position and provide a step stool adapted to support the weight of a person standing on the substantially horizontal surface when in the stool position.

Implementations of the invention may include one or more of the following features. The base is configured to fit in a sink basin. The lid is pivotally and slidably attached to the base near the mouth.

The device of can also include a tray slidably coupled to a front end of the base near the mouth, the tray being slidable between a tray tub position and a tray stool position, the tray extending substantially horizontally away from the mouth when in the tray tub position and being disposed at least partially over the cavity in the tray stool position. The is adapted to receive a portion of the lid when the lid and the tray are in their respective stool positions. The lid is slidable relative to the base and wherein the tray includes a plurality of bosses and the lid provides a plurality of recesses adapted to receive the bosses when the tray is in its stool position and the lid is moved into its stool position, thereby inhibiting sliding movement of the lid relative to the base. The lid is adapted to be slidably received by the base in the cavity when the lid is in its tub position. The lid is adapted to interfere with the bosses if the lid is moved from toward its stool position and the tray is displaced from the tray stool position.

The lid includes a high-friction top surface when the lid is in its stool position. The high-friction surface includes a plurality of ridges providing open-ended recesses between the ridges.

In general, in another aspect, the invention features a combination bathtub and step stool including a base adapted to mounted to a sink basin, the base providing a cavity adapted to receive an infant and to retain water. A back rest is slidably and pivotally coupled to the base, the back rest being adapted to have a lower portion thereof be slidably received within the cavity along an angled back wall of the cavity and to have an upper portion thereof extend angularly away from the cavity in a back rest tub position, the back rest being further adapted to be moved to a back rest stool position extending substantially horizontally over at least a portion of the cavity. A tray is slidably coupled to the base between a tray tub position and a tray stool position, the tray being adapted to receive a portion of the back rest when the back rest is pivoted to a back rest stool position and the tray is in a tray stool position. The cavity is substantially covered and a top surface is provided for a person to stand thereon when the back rest and tray are in the back rest stool position and the tray stool position, respectively.

Implementations of the invention may include one or more of the following features. A top surface of the back rest is substantially planar with a top of the tray when the back rest and tray are in the back rest stool position and the tray stool position, respectively. The back rest is slidable between the back rest tub position and a pivoting position, and is pivotable between the pivoting position and the back rest stool position.

In general, in another aspect, the invention features a foldable bathtub and step stool combination including a base including a plurality of legs and providing an infant-receiving cavity and a drain opening in a bottom of the cavity, at least the plurality of legs being sized and disposed to fit within a sink basin, the infant-receiving cavity configured to receive a portion of an infant and to hold water when the drain opening is plugged, the base being configured to support the weight of a person. A back rest is pivotally and slidably attached to a top back end of the base into a back rest tub position and a back rest stool position, the back rest being disposed partially in and extending out of the infant-receiving cavity of the base and providing a surface adapted to receive an upper portion of an infant when in the back rest tub position, the back rest being disposed over the infant-receiving cavity and providing a substantially horizontal surface adapted to support the weight of the person when in the back rest stool position, the back rest including a plurality of recesses. A tray is slidably coupled to a front top end of the base between a tray tub position and a tray stool position, the tray receiving a portion of the back rest when the back rest and the tray are in their respective stool positions, the tray extending laterally away from the top of the base when the tray is in the tray tub position, the tray including a plurality of bosses adapted and disposed to be received by the back rest recesses when the tray is in the tray stool position and the back rest is moved into the back rest stool position, thereby inhibiting sliding movement of the back rest relative to the base.

Various embodiments of the invention may provide one or more of the following advantages. A single system can be used as a bathtub and quickly and easily converted for use as a step stool. A step stool can store items in an internal compartment. An infant bathtub can be reconfigured for use even when there is no need for the bathtub. Costs associated with items of short-term need for rearing a child can be reduced.

Other features and advantages of the invention will be evident from the following detailed description, including the drawings, and the claims.

DESCRIPTION OF PREFERRED EMBODIMENTS

The invention provides a combination fold-away bathtub and step stool system. The system can be configured as a bathtub and as a step stool. Quick and easy adjustments change the system from the bathtub configuration to the step stool configuration and vice versa. Using the invention, an infant can be safely bathed in the system when in the bathtub configuration and a person can use the system as a step stool in standard fashion when the system is in the step stool configuration.

Figure 1:
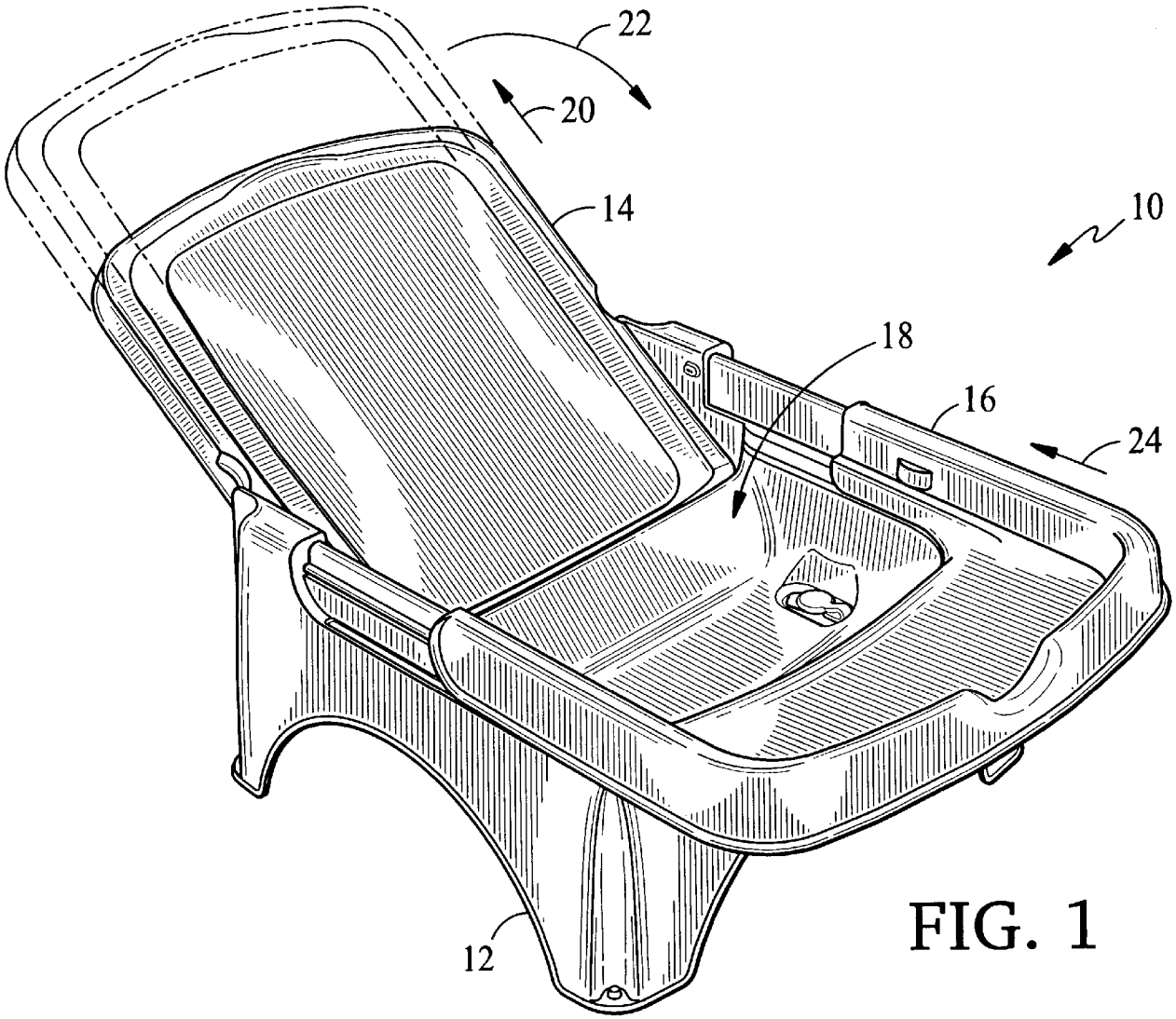
FIG. 1 is a perspective view of a fold-away bathtub and step stool system in a bathtub configuration.

As shown in FIG. 1, a fold-away bathtub and step stool system 10 includes a base 12, a back rest 14, and a tray 16. As shown, the system 10 provides a reservoir 18 for holding an infant (not shown) and water for bathing the infant. The back rest 14 extends upwardly from within the reservoir 18 away from the base 12 so that the infant can be bathed in a reclining position. The tray 16 extends forwardly from the base 12, providing room for the infant's legs to extend forward. The back rest 14 can be slid in direction 20 from its bathtub position shown in solid lines to its pivoting position shown in dashed lines and rotated in direction 22 to its stool position shown in FIG. 2, and the tray 16 can be slid in direction 24 from its bathtub position shown in FIG. 1 to its step stool position shown in FIG. 2, to put the system 10 in the step stool configuration shown in FIG. 2.

Figure 2:
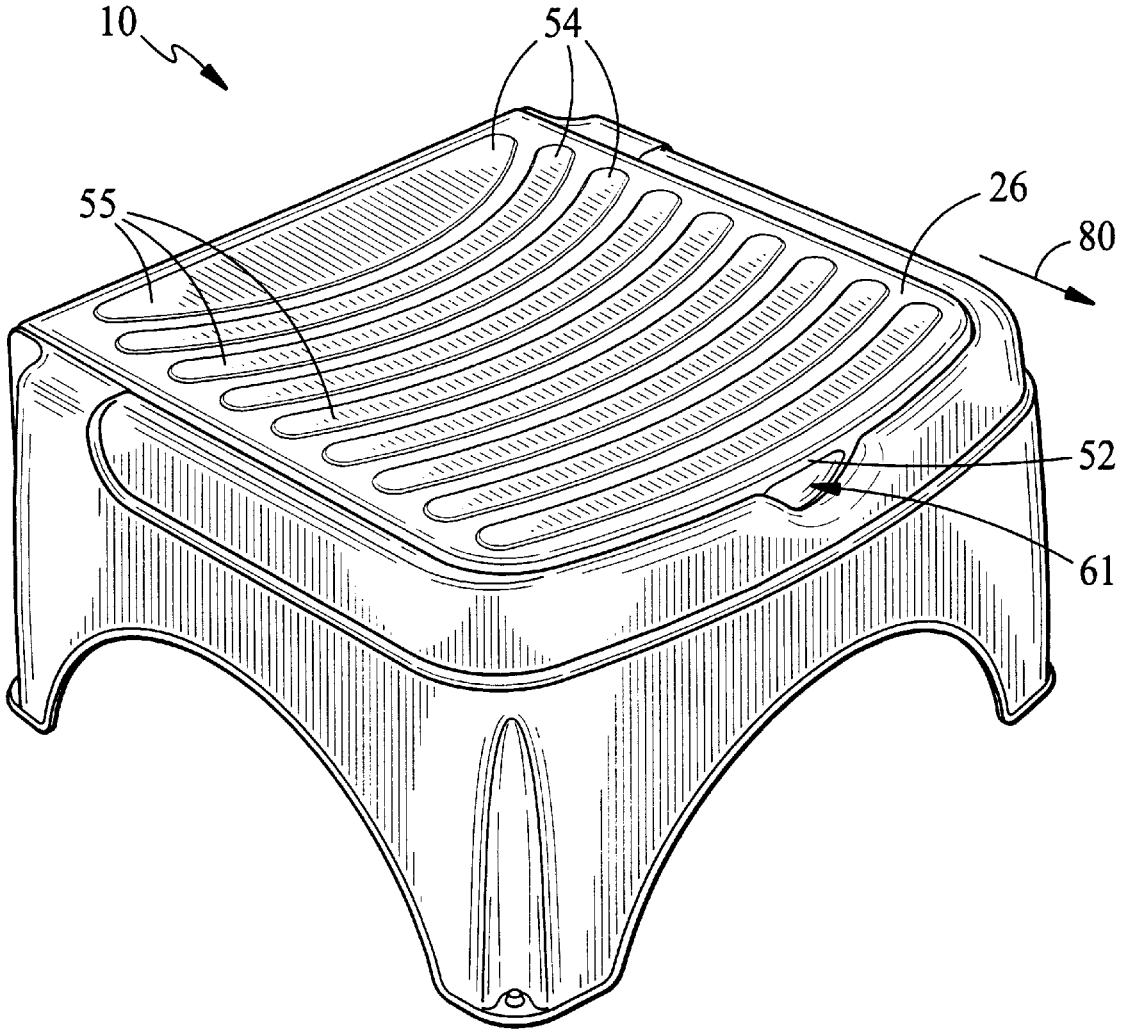
FIG. 2 is a perspective view the system shown in FIG. 1 in a step stool configuration.

As shown in FIG. 2, the system 10 provides a step stool for use, preferably, for persons from infant to adult. The step stool includes a high-friction top surface 26 that is substantially horizontal, is capable of supporting the weight of an adult, and provides traction to help prevent slippage of the adult when standing on the stool.

Figure 3:
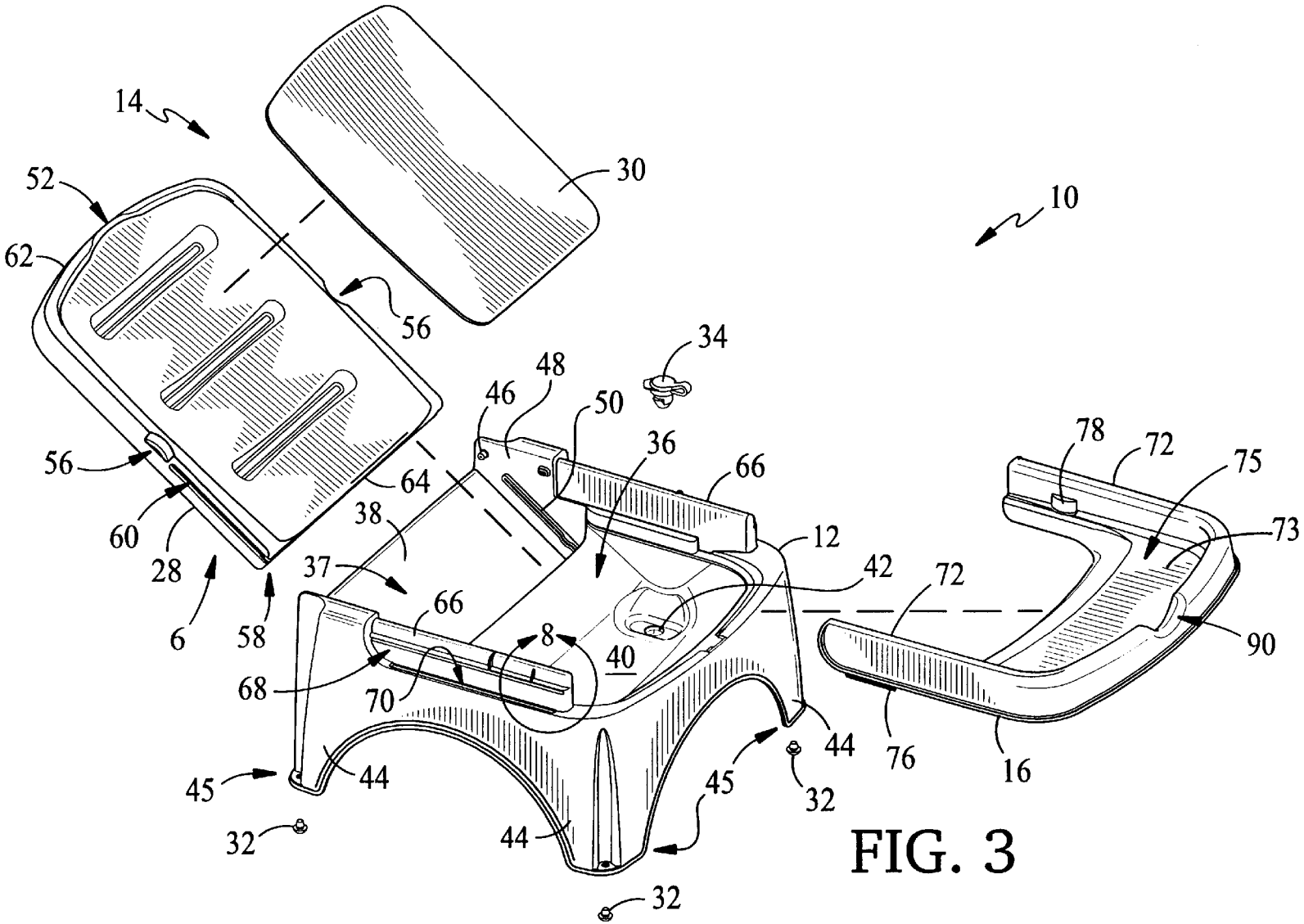
FIG. 3 is a top perspective exploded view of the system shown in FIG. 1.
Figure 4:
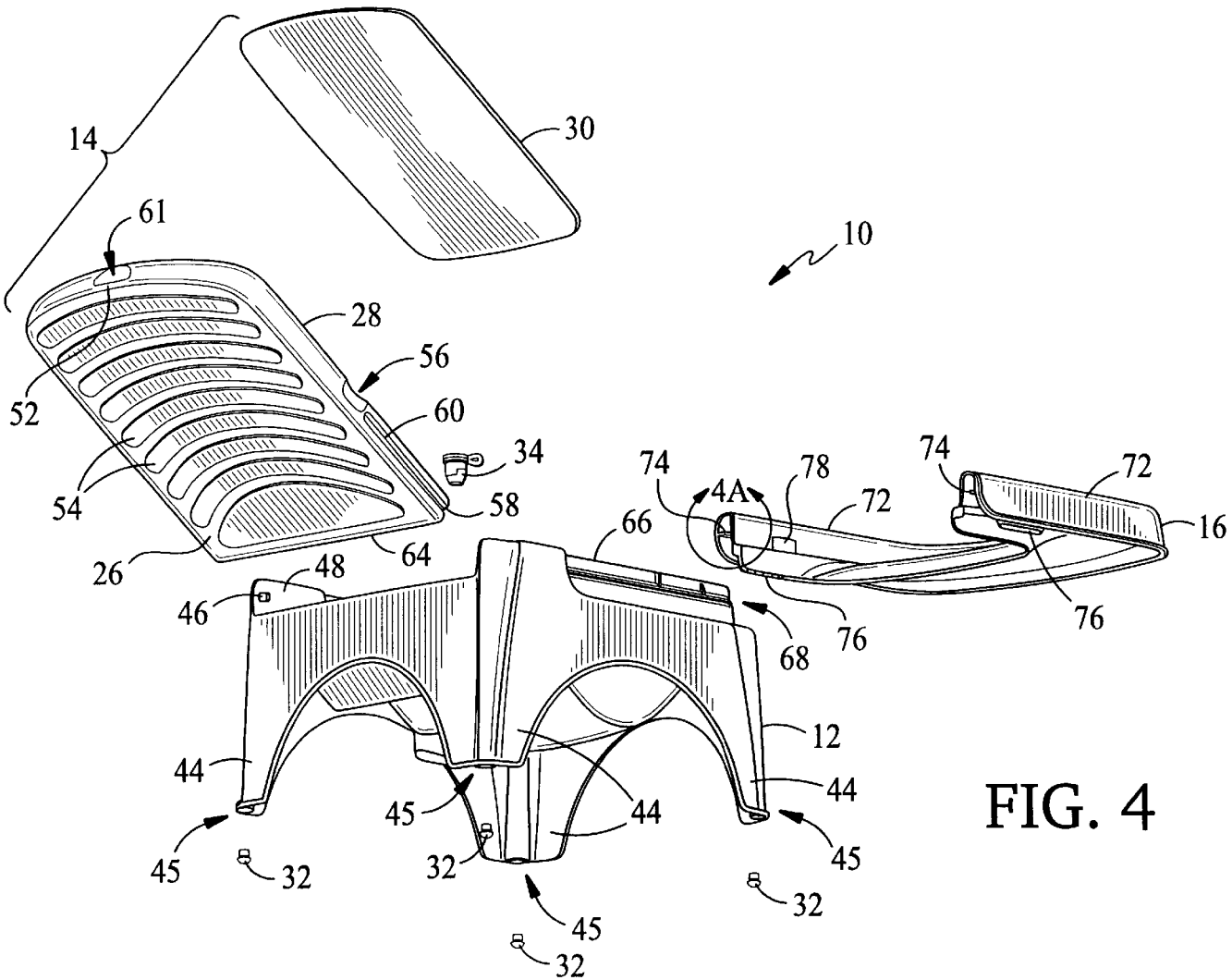
FIG. 4 is a bottom perspective exploded view of the system shown in FIG. 1.

Referring to FIGS. 3–4, the system 10 includes the base 12, the back rest 14, which includes a back plate 28 and a pad 30, and the tray 16. The base 12 and tray 16 can be made from polypropylene, and the back rest can be made from high-density polyethylene (HDPE).

Figure 6:
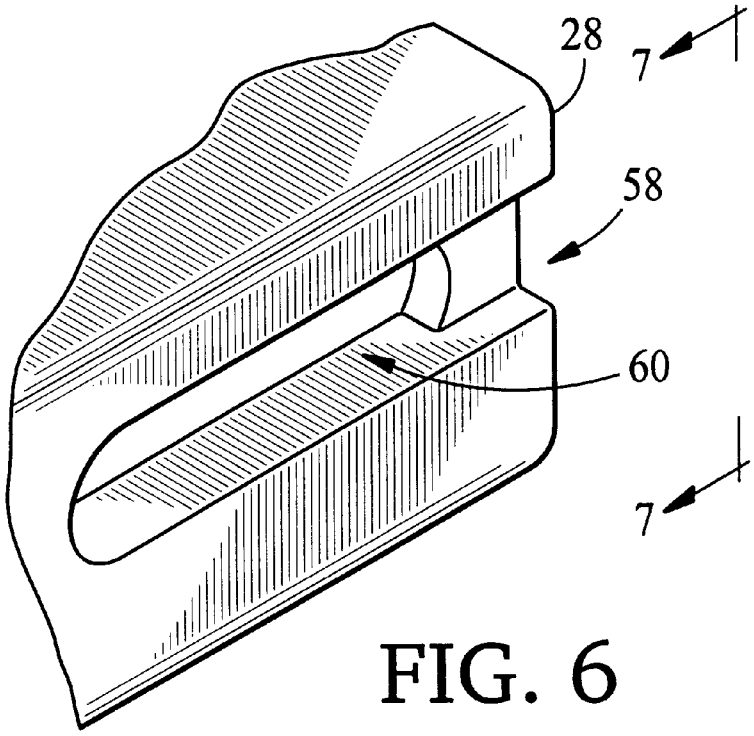
FIG. 6 is an enlarged, fragmentary, perspective view of an end portion of a back plate shown in FIG. 3 viewed in a direction indicated by arrow 6 in FIG. 3.
Figure 7:
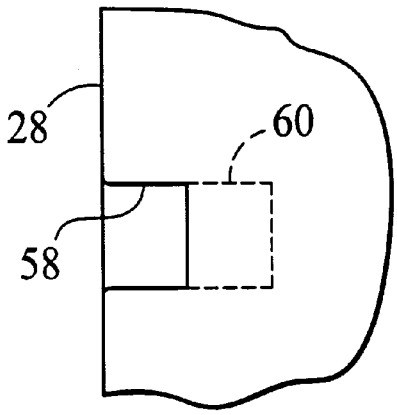
FIG. 7 is an enlarged, fragmentary, schematic view of the end portion of the back plate shown in FIG. 6 viewed on line 7—7 shown in FIG. 6.

Referring also to FIGS. 2–7, the back rest 14 includes a lip 52, several protrusions 54 on high-friction surface 26, two arcuate recesses 56, a slot 58 with one open end and one closed end, and a slot 60 within slot 58, best shown in FIG. 6, with two closed ends. The lip 52 provides a reduction in the thickness of, and a recess 61 in, a top edge 62 of the back rest 14 that is wide enough to receive two or more fingertips of an adult. As shown in FIG. 2, protrusions 54 are disposed along a length, and extend across a width, of the top of the system 10 in the stool configuration. The protrusions 54 have textured top surfaces 55 to provide traction for a person stepping on the stool. The protrusions 54 and their textured surfaces provide friction to guard against slipping of a person standing on the top surface 26 of the stool. The arcuate recesses 56 are shown disposed about midway along a length of the back rest 14 and extend inwardly from the sides of the back rest 14. The open-ended slot 58 extends from its open end at a bottom end 64 of the back rest 14 toward the top end 62 to its closed end. The closed slot 60 has substantially the same width as the slot 58, but is extends further inwardly from the sides of the back rest 14 than the slot 58. The slots 58 and 60 share a closed end. The slots 58 and 60 are configured to receive portions of the base 12 to slidably and pivotally couple to the base 12.

Referring to FIGS. 3–4, the base 12 includes two posts 46 (only one is shown in each of FIGS. 3–4) and two ribs 50 (only one is shown in FIG. 3) adapted to be received by the slots 60 and 58, respectively. The posts 46 extend inwardly from side walls 48 of the base 12. The posts are located near the upper back end of the cavity 36. The ribs 50 extend inwardly from and along a length of the walls 48 substantially parallel to the angled wall 38. The ribs 50 extend inwardly from the walls 48 less (i.e., a smaller distance) than the posts 46. The posts 46 are configured to slidably fit within the slots 60 and the ribs 50 are configured to slidably fit within the slots 58 but not to extend far enough to extend within the slots 60 when the system 10 is assembled as described below.

The base 12 is designed to hold an infant in a cavity 36 and to support the weight of a child or an adult. The cavity 36 is shaped to allow an infant to sit in the cavity 36, having a top opening or mouth 37 shaped to accommodate the lower torso and upper legs of the infant in a bent position. An angled wall 38 provides an upper rear portion of the cavity 36. A lower portion of the cavity 36 is a trough 40 shaped to accommodate the buttocks of the infant. In the trough 40 is a drain 42 through the bottom of the base 12 to allow liquid in the cavity 36 to drain out. The base includes four legs 44, with bottom portions 45, configured to be placed on a surface such as a floor or the bottom of a sink basin and to support the weight of an adult standing on the system 10 in the step stool configuration. The base 12 is configured such that at least the bottom portions 45 will all fit within a standard sink basin simultaneously. The system 10 also includes four non-skid feet (only three shown in FIG. 3) 32, and a plug 34. The feet 32 and plug 34 can be made from rubber and configured to fit within holes in the bottom portions 45 of the base 12 and in the drain 42.

Figure 8:
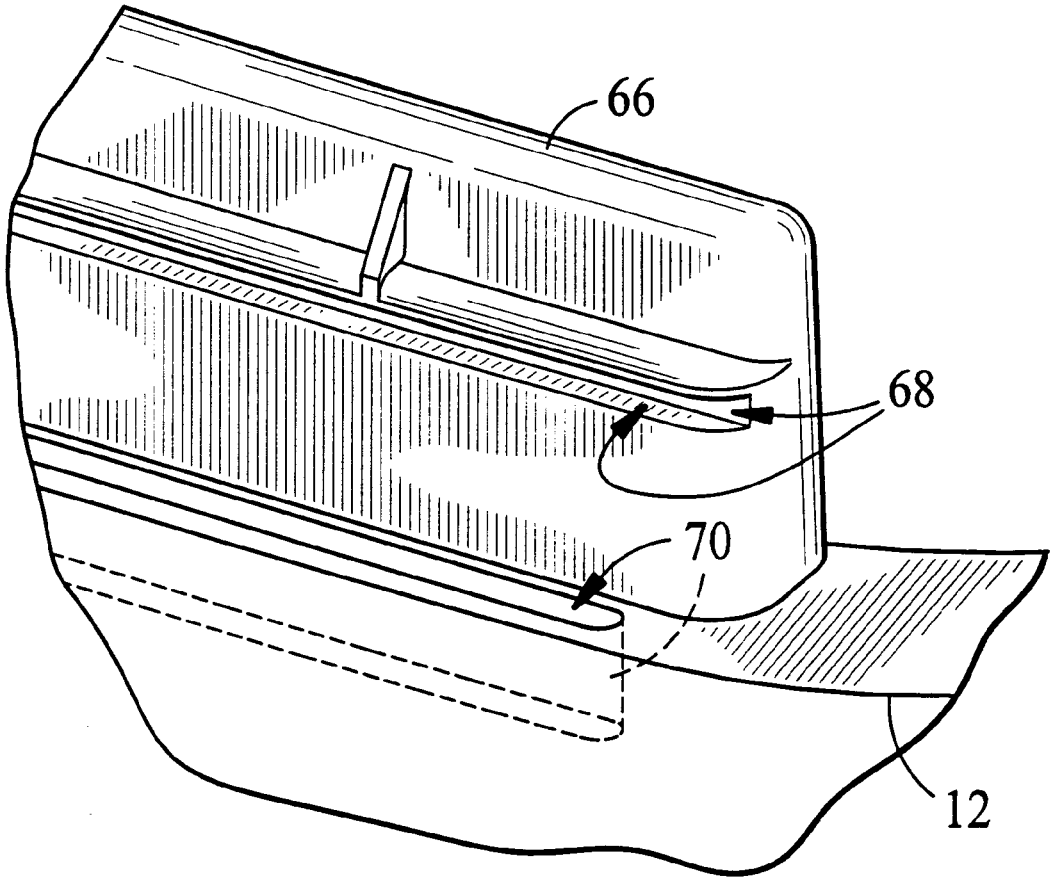
FIG. 8 is an enlarged, fragmentary, perspective view of an end portion of an arm of a base shown in FIG. 3 as indicated by a circle 8—8 in FIG. 3.

Referring also to FIG. 8, the base also includes two arms 66, two horizontal, outwardly facing slots 68 (only one of which is shown), and two vertical, downwardly extending slots 70 (only one of which is shown) located outwardly beside horizontal slots 68. The arms 66 each extend along the majority of one side of the base 12. The slots 68 extend into the portions of the arms 66 recessed from the sides of the base 12 and along the lengths of the arms 66. The slots 70 extend downwardly between the arms 66 and sides of the base 12. Drainage holes (not shown) are disposed in the bottoms of the slots 70 to allow liquid to drain out of the slots 70. The arms 66, slots 68, and slots 70 are configured to slidably receive the tray 16.

Figure 4A:
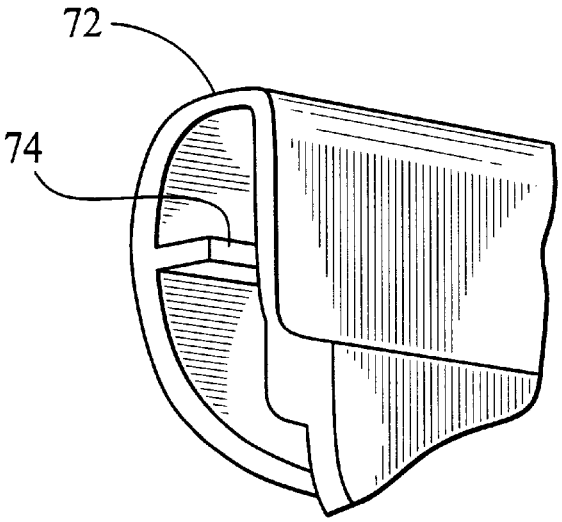
FIG. 4A is an enlarged, fragmentary, perspective view of an end portion of a tray shown in FIG. 4 as indicated by a circle 4A—4A in FIG. 4.
Figure 5:
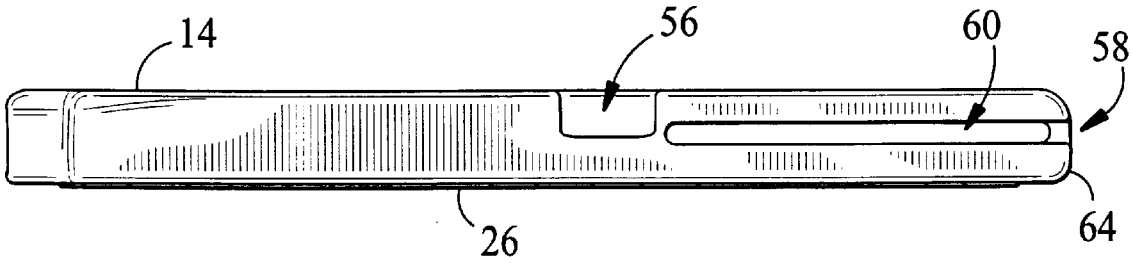
FIG. 5 is a side view of a back rest shown in FIG. 1.

The tray 16 includes sleeves 72, inwardly extending horizontal ribs 74 (FIGS. 4 and 4A; only one rib 74 shown in FIG. 4A), and downwardly extending tabs 76 (only one shown in FIG. 3) adapted to mate with arms 66, slots 68, and slots 70, respectively. The sleeves 72 are shaped to slidably fit over the arms 66 of the base 12 and define a raised periphery around the three outer sides of the tray 16 and a recess 75. The bottom of the recess 75 is provided by a tray surface 73 that is recessed below the outer periphery of the tray 16. Also, the ribs 74 are sized, shaped, and located within the outer walls of the sleeves 72 to slidably fit within the slots 68. Similarly, the tabs 76, located at the bottom of the outer walls of the sleeves 72, are configured to slidably fit within the slots 70. Having the ribs 74 and tabs 76 received by the slots 68 and 70 helps maintain the positioning of the tray 16 relative to the base 12, with the sleeves 72 receiving the arms 66, while limiting the range of slide of the tray 16 relative to the base 12 due to the tabs hitting the ends of the slots 70.

The tray 16 provides a notch 90. The notch 90 has a somewhat semi-circular periphery and is sized to allow passage of two or more fingertips of an adult through the notch 90 and below the top of the tray 16.

The tray 16 also includes two bosses 78 (only one shown) that are configured to mate with the recesses 56 of the back rest 14. The bosses 78 are partially disk-shaped, having an arcuate side and a flat top and a flat bottom. These bosses 78 are located such that when the tray 16 is moved into its step stool position shown in FIG. 2 and the back rest 14 is pivoted into its step stool position shown in FIG. 2, the bosses 78 are received by the recesses 56. In this position, the tray 16 is inhibited from sliding in direction 80 (FIG. 2) toward its bathtub position. These bosses 78 also prevent the back rest 14 from laying flat if the tray 16 is not fully in its step stool position.

The system 10 can be formed and assembled as follows. The base 12 and the tray 16 is injection molded of polypropylene. The back plate 28 is blow molded of HDPE. The pad 30 is formed, e.g., from foam die-cut to the desired shape and attached, e.g., with pressure-sensitive adhesive, to the back plate 28 to form the back rest 14. The back rest 14 is inserted onto the base such that the posts 46 are received within the slots 60. The tray 16 is coupled to the base 12 such that the sleeves 72 are aligned over the arms 66, and the ribs 74 and tabs 76 are received by the slots 68 and 70, respectively. The feet 32 are affixed to the bottom portions 45 of the base legs 44 and the plug 34 is affixed within the drain 42.

In operation, the system 10 can be used as an infant bathtub and quickly and easily converted to a step stool, or vice versa. When in the bathtub configuration shown in FIG. 1, with the back rest in the back rest tub position and the tray in the tray tub position, an infant can be placed into the reservoir 18, with the infant's buttocks fitting into the cavity 36 (FIGS. 3–4), the infant's back extending along the back rest 14, and the infant's legs being supported by the tray 16. In this position, the reservoir 18 can be filled with water and the infant bathed, the plug 34 helping to retain the water in the reservoir 18. The plug can be opened to drain the water from the reservoir 18. Items can be placed in the reservoir for storage, if desired.

From the bathtub configuration, the tray 16 is slid in direction 24 (FIG. 1) until tabs 76 reach the ends of slots 70 such that the tray 16 is in the tray stool position. The back rest is slid in direction 20 (FIG. 1) with the ribs 50 sliding in the open-ended slots 58 and the posts 46 sliding in the closed slots 60 until the posts 46 hit the ends of the closed slots 60, such that the back rest is in the pivoting position (shown in dashed lines in FIG. 1). The back rest 14 is pivoted in direction 22 (FIG. 1) into the back rest stool position shown in FIG. 2, being received in the recess 75 of the tray 16 and the bosses 78 being received by the recesses 56. In this position, the top surface 26 and the top of the sleeves 72 are substantially planar as shown in FIG. 2. A person can stand or sit on the top surface 26 of the system 10. Items stored in the reservoir 18 can be accessed by moving the system 10 toward the tub configuration shown in FIG. 1.

From the stool configuration, the system 10 can be repositioned to the tub configuration. One or more fingertips are inserted through the notch 90 in the tray 16 and into the recess 61 below lip 52. The lip 52 is pulled to rotate the back rest in a direction 82, opposite direction 22, and the back rest 14 slid in a direction 84, opposite direction 20, so that the slots 58 slidably receive ribs 50 until the back rest 14 reaches its tub position. The tray 16 is slid in direction 80 until it reaches its tub position.

Other embodiments are within the scope and spirit of the appended claims.

What is claimed is:

1. A device comprising:

a base providing an upwardly-directed cavity having a mouth at an upper end thereof and configured to receive a portion of a child and to hold water; and a lid movably coupled to the base and movable into a tub position and a stool position, the lid being pivotally and slidably attached to the base near the mouth, such that the lid is pivotable away from the base from its stool position, and then slidable into the base to its tub position, the lid extending angularly upward and away from the cavity to provide a back rest when in the tub position and the lid being disposed at least partially over the mouth and providing a substantially horizontal top surface when in the stool position;

wherein the base and lid provide a bathtub capable of holding a portion of a child therein and water for bathing the child when the lid is in the tub position and provide a step stool adapted to support the weight of a person standing on the substantially horizontal surface when in the stool position.

2. The device of claim 1 wherein the base is configured to fit in a sink basin.

3. The device of claim 1 further comprising a tray slidably coupled to a front end of the base near the mouth, the tray being slidable between a tray tub position and a tray stool position, the tray extending substantially horizontally away from the mouth when in the tray tub position and being disposed at least partially over the cavity in the tray stool position.

4. The device of claim 3 wherein the tray is adapted to receive a portion of the lid when the lid and the tray are in their respective stool positions.

5. The device of claim 4 wherein the tray includes a plurality of bosses and the lid provides a plurality of recesses adapted to receive the bosses when the tray is in its stool position and the lid is moved into its stool position, thereby inhibiting sliding movement of the lid relative to the base.

6. The device of claim 5 wherein the lid is adapted to be slidably received by the base in the cavity when the lid is in its tub position.

7. The device of claim 5 wherein the lid is adapted to interfere with the bosses if the lid is moved from toward its stool position and the tray is displaced from the tray stool position.

8. The device of claim 1 wherein the lid includes a high-friction top surface when the lid is in its stool position.

9. The device of claim 8 wherein the high-friction surface includes a plurality of ridges providing open-ended recesses between the ridges.

10. A combination bathtub and step stool comprising:

a base adapted to mounted to a sink basin, the base providing a cavity adapted to receive an infant and to retain water;

a back rest slidably and pivotally coupled to the base, the back rest adapted to have a lower portion thereof be slidably received within the cavity along an angled back wall of the cavity and to have an upper portion thereof extend angularly away from the cavity in a back rest tub position, the back rest being further adapted to be moved to a back rest stool position extending substantially horizontally over at least a portion of the cavity; and a tray slidably coupled to the base between a tray tub position and a tray stool position, the tray being adapted to receive a portion of the back rest when the back rest is pivoted to a back rest stool position and the tray is in a tray stool position;

wherein the cavity is substantially covered and a top surface is provided for a person to stand thereon when the back rest and tray are in the back rest stool position and the tray stool position, respectively.

11. The combination of claim 10 wherein a top surface of the back rest is substantially planar with a top of the tray when the back rest and tray are in the back rest stool position and the tray stool position, respectively.

12. The combination of claim 10 wherein the back rest is slidable between the back rest tub position and a pivoting position, and is pivotable between the pivoting position and the back rest stool position.

13. A foldable bathtub and step stool combination comprising:

a base including a plurality of legs and providing an infant-receiving cavity and a drain opening in a bottom of the cavity, at least the plurality of legs being sized and disposed to fit within a sink basin, the infant-receiving cavity configured to receive a portion of an infant and to hold water when the drain opening is plugged, the base being configured to support the weight of a person;

a back rest pivotally and slidably attached to a top back end of the base into a back rest tub position and a back rest stool position, the back rest being disposed partially in and extending out of the infant-receiving cavity of the base and providing a surface adapted to receive an upper portion of an infant when in the back rest tub position, the back rest being disposed over the infant-receiving cavity and providing a substantially horizontal surface adapted to support the weight of the person when in the back rest stool position, the back rest including a plurality of recesses;

a tray slidably coupled to a front top end of the base between a tray tub position and a tray stool position, the tray receiving a portion of the back rest when the back rest and the tray are in their respective stool positions, the tray extending laterally away from the top of the base when the tray is in the tray tub position, the tray including a plurality of bosses adapted and disposed to be received by the back rest recesses when the tray is in the tray stool position and the back rest is moved into the back rest stool position, thereby inhibiting sliding movement of the back rest relative to the base.

14. A device comprising:

a base providing an upwardly-directed cavity having a mouth at an upper end thereof and configured to receive a portion of a child and to hold water; and a lid movably coupled to the base and movable into a tub position and a stool position, the lid extending angularly upward and away from the cavity to provide a back rest when in the tub position and the lid being disposed at least partially over the mouth and providing a substantially horizontal top surface when in the stool position; and a tray slidably coupled to a front end of the base near the mouth, the tray being slidable between a tray tub position and a tray stool position, the tray extending substantially horizontally away from the mouth when in the tray tub position and being disposed at least partially over the cavity in the tray stool position;

wherein the base and lid provide a bathtub capable of holding a portion of a child therein and water for bathing the child when the lid is in the tub position and provide a step stool adapted to support the weight of a person standing on the substantially horizontal surface when in the stool position.

15. The device of claim 14 wherein the tray is adapted to receive a portion of the lid when the lid and the tray are in their respective stool positions.

16. The device of claim 15 wherein the lid is slidable relative to the base and wherein the tray includes a plurality of bosses and the lid provides a plurality of recesses adapted to receive the bosses when the tray is in its stool position and the lid is moved into its stool position, thereby inhibiting sliding movement of the lid relative to the base.

17. The device of claim 16 wherein the lid is adapted to be slidably received by the base in the cavity when the lid is in its tub position.

18. The device of claim 16 wherein the lid is adapted to interfere with the bosses if the lid is moved from toward its stool position and the tray is displaced from the tray stool position.

* * * * *